United States Patent [19]

Gritzner

[11]B 4,035,255

[45] July 12, 1977

[54] OPERATION OF A DIAPHRAGM ELECTROLYLYTIC CELL FOR PRODUCING CHLORINE INCLUDING FEEDING AN OXIDIZING GAS HAVING A REGULATED MOISTURE CONTENT TO THE CATHODE

[75] Inventor: Gerhard Gritzner, Midland, Mich.

[73] Assignee: The Dow Chemical Company, Midland, Mich.

[21] Appl. No.: 361,743

[22] Filed: May 18, 1973

[44] Published under the first Trial Voluntary Protest Program on Jan. 28, 1975 as document No. B 361,743

[51] Int. Cl. .....C25B 1/16, C25B 1/26, C25B 11/03

[52] U.S. Cl. ..... 204/98; 204/128; 204/265; 204/266; 204/277; 204/DIG. 3

[58] Field of Search ..... 204/98, 128, 265, 266, 204/277, DIG. 3

[56] References Cited

U.S. PATENT DOCUMENTS

| | | | |
|---|---|---|---|
| 2,681,884 | 6/1954 | Butler, Jr. | 204/98 |
| 3,262,868 | 7/1966 | Juda | 204/98 |
| 3,616,328 | 10/1971 | Currey | 204/98 |

FOREIGN PATENT DOCUMENTS

| | | | |
|---|---|---|---|
| 832,196 | 4/1960 | United Kingdom | 204/98 |
| 700,933 | 12/1964 | Canada | 204/78 |

OTHER PUBLICATIONS

Kirk-Othmer, "Encyclopedia of Chemical Technology," Vol. 3 (1964), p. 147.

Kirk-Othmer, "Encyclopedia of Chemical Technology," Supplement Vol. (1971), pp. 386 and 387.

*Primary Examiner*—John H. Mack
*Assistant Examiner*—Arthur C. Prescott
*Attorney, Agent, or Firm*—Robert W. Selby

[57] ABSTRACT

Improved apparatus and process to electrolytically produce chlorine gas and an alkali metal hydroxide in a diaphragm cell. The improved process comprises circulating the catholyte and contacting a foraminous cathode with an oxidizing gas having a regulatably controlled moisture content.

10 Claims, 2 Drawing Figures

OPERATION OF A DIAPHRAGM ELECTROLYLYTIC CELL FOR PRODUCING CHLORINE INCLUDING FEEDING AN OXIDIZING GAS HAVING A REGULATED MOISTURE CONTENT TO THE CATHODE

BACKGROUND OF THE INVENTION

This invention pertains to the electrolytic production of chlorine in a diaphragm cell and more in particular to an electrolytic cell containing an oxidizing gas depolarized cathode and a method of producing chlorine and an alkali metal hydroxide in such electrolytic cell.

Gaseous chlorine has long been produced from sodium chloride in an electrolytic cell having an anode positioned within an anode chamber and a cathode in a cathode chamber spaced apart from the anode chamber by an ion and liquid permeable diaphragm, such as one at least partially formed of asbestos. In such an electrolytic cell chlorine is released at the anode and sodium hydroxide is formed in the cathode chamber.

Various methods to conserve electrical power in electrolytic cells have been developed using porous cathodes in combination with an oxidizing gas to depolarize the electrode; see for example, Juda, U.S. Pat. No. 3,124,520. It is desired to provide an improved apparatus and process to reduce the electrical consumption of chlorine producing electrolytic diaphragm cells.

SUMMARY OF THE INVENTION

An improved electrolytic cell to produce chlorine and an alkali metal hydroxide has been developed. The electrolytic cell comprises an anode compartment suited to contain an anolyte such as an aqueous solution or mixture of an alkali metal chloride, for example, sodium chloride. A cathode compartment adapted to contain a catholyte containing the hydroxide of the alkali metal is spaced apart from the anode compartment by a diaphragm. The diaphragm separating the anode and cathode compartments is suited to pass ions of at least the alkali metal from the anode compartment to the cathode compartment. The diaphragm is suitably positioned in the electrolytic cell to substantially entirely separate the anode compartment from the cathode compartment.

An anode is suitably positioned within the anode compartment and a cathode is suitably positioned within the cathode compartment to be spaced apart from the diaphragm, that is substantially all of the catholyte is contained within a space or opening at least partially defined by the diaphragm and at least partially by an outer surface of the cathode. The cathode is further adapted to have at least one wall portion in contact with the catholyte and at least one other wall portion substantially simultaneously in contact with an oxidizing gas.

A means to circulate the catholyte at least within the cathode compartment is in operative combination with the cathode compartment. A means to control the moisture content of the oxidizing gas in contact with the cathode is in operative combination with the cathode.

A means to supply a direct current to the anode and the cathode is suitably electrically connected to these electrodes. The electrolytic cell further includes a means to remove the chlorine produced from the anode compartment and a means to remove the alkali metal hydroxide formed from the cathode compartment.

The described electrolytic cell is advantageously used in an improved process to produce chlorine and an alkali metal hydroxide. In the improved process an alkali chloride brine is fed into the anode compartment. At least a portion of the brine containing alkali metal ions passes through the diaphragm into the cathode chamber. Sufficient electrical energy is supplied to the anode and cathode to release gaseous chlorine at the anode and to form the alkali metal hydroxide in the cathode compartment. The gaseous chlorine and alkali metal hydroxide are suitably recovered by means known to those skilled in the art.

The electrical efficiency of the cell is improved by substantially simultaneously contacting different wall portions of the cathode with the catholyte and with an oxidizing gas. The moisture content of the oxidizing gas is suitably controlled to minimize drying and deposition of materials such as sodium chloride, sodium hydroxide and the like on the cathode surface. The catholyte is circulated within the cathode compartment to maximize contact between the catholyte and the cathode to thereby further improve the electrical efficiency of the cell.

DESCRIPTION OF THE DRAWING

The accompanying drawing further illustrates the invention.

Identical numbers, distinguished by a letter suffix, within the several figures represent parts having a similar function within the different embodiments.

DESCRIPTION OF THE PREFERRED EMBODIMENTS

Figure 1:
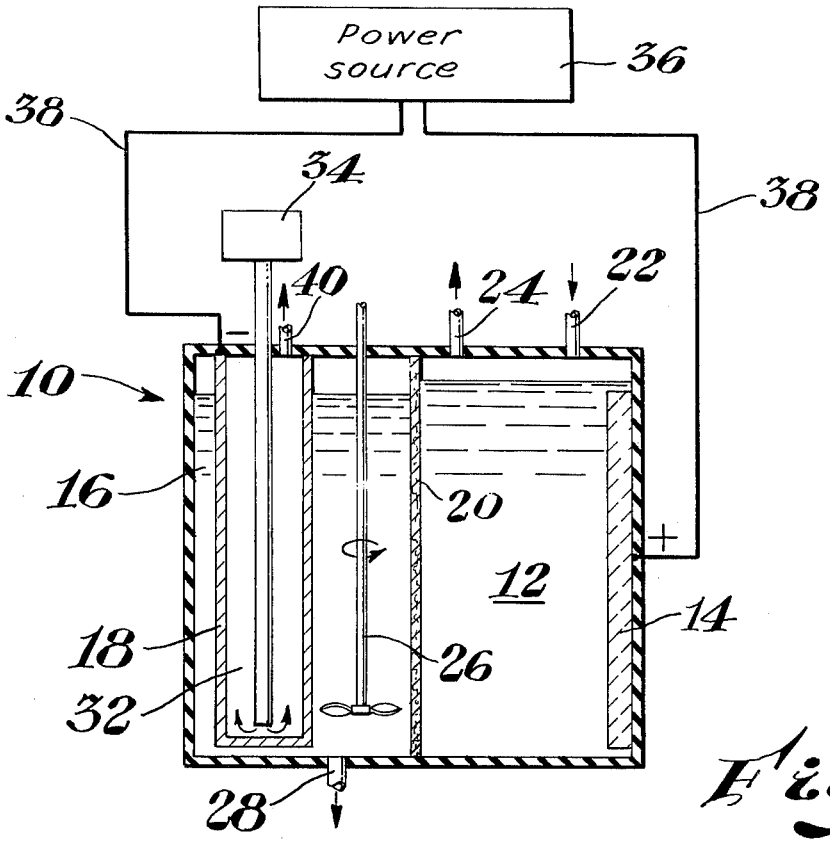
In FIG. 1 is depicted a cross sectional view of one embodiment of the invention.

An electrolytic cell 10 of FIG. 1 includes an anode compartment 12 with an anode 14 positioned therein juxtaposed and spaced apart from a cathode compartment 16 with a depolarized cathode 18 positioned therein. The anode compartment 12 is spaced apart from the cathode compartment 16 by a diaphragm 20 capable of passing at least alkali metal ions from the anode compartment 12 to the cathode compartment 16. The electrolytic cell 10 further includes a source of alkali metal chloride brine (not shown) and a means 22 to introduce or feed the brine into the anode compartment 12. A gaseous chlorine removal means such as a pipe 24 is suitably connected to the anode compartment 12 to afford removal of gaseous chlorine without substantial loss of chlorine to the ambient atmosphere.

A means, such as a pump, ultrasonic vibrator or a turbine type impeller 26, to circulate the catholyte at least within the cathode compartment 16 is suitably positioned within the cathode compartment 16 to afford circulation of the catholyte throughout the cathode compartment 16. During operation of the electrolytic cell 10 the catholyte contains increasing concentrations of an alkali metal hydroxide, such as sodium hydroxide, which for efficient operation should be removed from the cathode compartment 16 to reduce the hydroxide concentration. For this purpose an alkali metal hydroxide removal means such as pipe 28 is in combination with the cathode compartment 16.

The cathode 18 is formed of a material adapted to transmit or pass an ozidizing gas from a gas compartment 32 to the outer surface of the cathode 18. Preferably, formation of oxidizing gas bubbles on the outer surface of the cathode 18 is minimized and more preferably the outer surface of the cathode is substantially free of oxidizing gas bubbles. An oxidizing gas moisture control means 34 is provided to regulatably control the dew point of the oxidizing gas introduced into the gas compartment 32 to minimize and preferably substantially entirely eliminate accumulation of liquid water within the gas compartment 32. The moisture control means 34 is further adapted to maintain the oxidizing gas moisture content at a concentration adequate to minimize and preferably substantially entirely prevent removal of sufficient moisture from the catholyte within the cathode compartment 16 to result in deposition of solid materials such as sodium chloride or sodium hydroxide in, for example, the pores of the cathode 18. Preferably the moisture control means 34 is adapted to regulate the moisture content of the oxidizing gas within the range of from about 50 to 100 per cent of saturation.

The cathode 18, which is used in combination with the oxidizing gas control means 34, is preferably a foraminous body, such as a screen, expanded metal or a sheet with holes extending therethrough, having at least the surface thereof composed of a substantially inert material such as, for example Ru, Rh, Pd, Ag, Os, Ir, Pt and Au with a coating of a mixture of the particulate inert metal and for example, polytetrafluoroethylene, polyhexafluoropropylene and other polyhalogenated ethylene or propylene derivatives. Preferably the inert material is what is known in the art as platinum black, silver black and carbon black. Particulates which are designated as "black" generally and preferably have a U.S. Standard Mesh size range of less than about 300. Preferably the cathode 18 is a screen at least partially woven from or adherently coated with metallic platinum, silver or gold with a mesh size of about 30 to about 60.

A source of electrical energy 36 is electrically connected to an energy transmission or carrying means such as aluminum or copper conduit as bus bar or cables 38 to transmit direct electrical current to the anode 14 and the cathode 18.

In operation of the electrolytic cell an metal chloride containing brine, such as sodium chloride, is supplied or fed through the brine feed means 22 into the anode chamber 12 wherein, through electrolytic processes known to those skilled in the art, gaseous chlorine is formed and removed through pipe 24 and thence to a chlorine condensing and storage system (not shown). Sodium ions pass through the asbestos diaphragm 20 into the cathode compartment 16 wherein sodium hydroxide is formed. An oxidizing gas, preferably oxygen, is fed into the gas compartment 32 within the cathode 18 substantially simultaneously with formation of the sodium hydroxide. The presence of the oxidizing gas and the physical contact thereof with the inner surface of the cathode 18, while the outer surface of the cathode 18 is simultaneously in contact with the sodium hydroxide containing catholyte, is believed to minimize and preferably prevent formation of gaseous hydrogen in the cathode compartment 16 to thereby reduce the electrical consumption and improve the electrical efficiency of the cell. Excess oxidizing gas is removed from the gas compartment 32 through the oxidizing gas removal means or port 40.

To minimize what is believed to be formation of hydrogen at the cathode 18 it is desirable that substantially all of the catholyte comes into contact with the cathode. To promote such contact and reduce the occurrence of stagnant portions of catholyte within the cathode compartment 16 where little movement of the catholyte occurs, the catholyte is preferably circulated at a rate sufficient for substantially all of the catholyte to contact the cathode 18 and insufficient to result in physical injury to the asbestos diaphragm 20.

Figure 2:
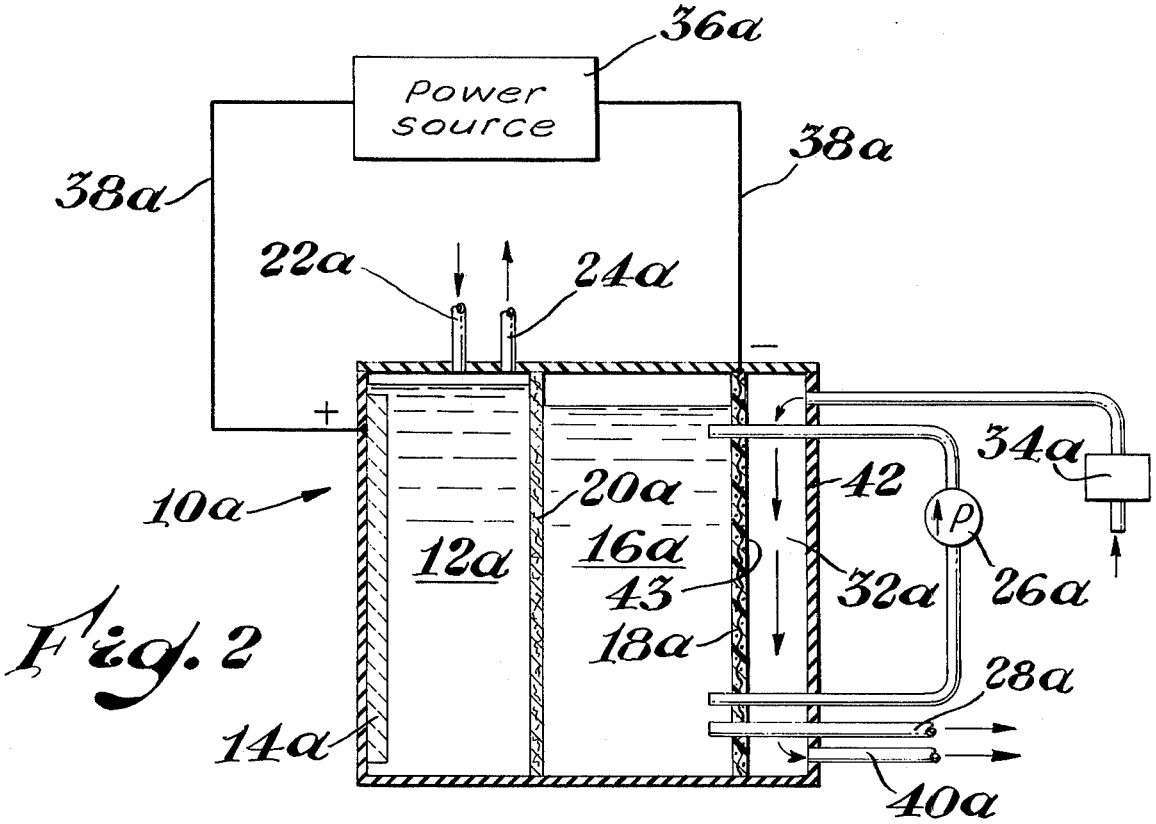
In FIG. 2 is a cross sectional view of another embodiment of the invention.

FIG. 2 is illustrative of an electrolytic cell 10a having therein an anode compartment or chamber **12*a* spaced apart from a cathode compartment or chamber 16*a* by an asbestos containing diaphragm 20*a* formed from, for example, asbestos sheet or particulate. An anode 14*a* is suitably attached in the anode chamber 12*a*. Likewise, a cathode 18*a* is suitably attached in the cathode compartment 16*a*.** The anode is constructed of a material such as carbon or what is known in the art as dimensionally stable anode such as titanium or tantalum coated or plated with materials including for example, at least one metal or oxide of the platinum group metals including Ru, Rh, Pd, Ag, Os, Ir, Pt and Au.

The cathode **18*a*** is preferably a metallic silver plated foraminous copper substrate such as a copper screen or sheet with a thickness of about 0.01 to about 0.02 inch and sufficient pores or holes with a diameter of about 0.015 to about 0.03 inch diameter extending therethrough to provide a total hole or open area equivalent to about 20 to about 40 per cent of that portion of the copper sheet having the greatest surface area. The foraminous copper sheet is preferably coated or plated with sufficient metallic silver to provide a substantially continuous silver layer with a thickness of up to about 0.002 inch. Plating of the copper substrate is carried out in a manner known to those skilled in the plating art. A screen woven from about 0.005 to about 0.02 inch diameter wire into a screen having a U.S. Standard Mesh size of about 20 to about 50 is satisfactory when plated with silver as described above. The silver plated copper substrate is coated with a mixture of platinum black, silver black or carbon black and, for example, polytetrafluoroethylene or a fluorinated copolymer of hexafluoropropylene or tetrafluoroethylene. The mixture preferably contains from about 30 to about 70 weight per cent carbon black with a mesh size of less than about 300 admixed with up to about 10 weight per cent carbon fibers. The balance of the mixture is essentially the organic material and impurities generally found in the carbon and the organic material. The organic mixture coated, silver plated copper is preferably substantially impervious to passage of the catholyte. The term copper includes commercially pure copper and alloys thereof containing at least 50 weight per cent copper.

The pump **26*a* together with appropriate conduits extending into the cathode chamber 16*a* are provided to afford effective circulation of the catholyte during operation of the cell 10*a*. Generally the catholyte will be pumped in a manner to enter at the upper portion of the cathode chamber 16*a*** and be withdrawn at the lower portion of the chamber; however, pumping can be carried out to remove catholyte at the upper portion of the cathode chamber.

The cathode 18a is spaced apart from a side portion or wall 42 of the cell 10a to form an opening or gas compartment 32a between the diaphragm 18a and the inner surface of the wall 42. An oxidizing gas with the moisture content suitably controlled by a moisture control means 34a is pumped into, preferably, the upper portion of the gas compartment 32a and flowed into intimate contact with the outer surface 43 of the cathode 18a and withdrawn through removal means 40a for disposal.

A brine supply means 22a and a chlorine removal means 24a are in combination with the anode chamber 12a. A sodium hydroxide containing catholyte is generally removed through a conduit 28a. A source of direct electrical current 36a is electrically connected to electrical conduits 38a which are in turn electrically attached to the anode 14a and the cathode 18a.

Operation of the electrolytic cell 10a is substantially the same as that described for the embodiment of FIG. 1 except that the catholyte is preferably circulated within the cathode chamber by pumping through the pump 26a.

The following examples further illustrate the invention.

EXAMPLES 1–33

An electrolytic cell substantially as shown in FIG. 2 with a drawn asbestos diaphragm, a graphite anode and a 3½ inch by 3½ inch coated platinum screen depolarized cathode was used in the examples. The depolarized cathode included about a 45 mesh platinum metal screen which had been coated with Teflon by first spray coating a 3½ inch by 3½ inch piece of aluminum foil with sufficient duPont Teflon 30B to form a layer of 16 milligrams of Teflon per square inch of aluminum surface. The Teflon coated surface was then oven dried for 1 minute at a temperature of 360°C. a 2½ inch diameter portion of the Teflon coated surface and a similar area of a second uncoated aluminum foil surface was coated with a mixture of metallic platinum having a mesh less than 300, 1 milliliter of water and 0.053 milliliter of Teflon 30B latex. After uniformly distributing the mixture over the aluminum foil surfaces the coating was air dried and then cured by slowly heating to a temperature of 350°C. The platinum screen was then interposed between the coated surfaces of the aluminum foil. The aluminum foil-screen composite was compressed under a pressure of 2,000 lbs. per square inch and simultaneously heated for 2 minutes at a temperature of 360°C. The composite was cooled and then placed in a 20 per cent sodium hydroxide solution to dissolve the aluminum foils. The composite cathode was washed and dried before being positioned in the electrolytic cell with the Teflon coated surface forming a wall portion of the gas compartment.

The cell was operated using an electrode area of 3.14 square inches for each the anode and cathode. The spacing between the anode and cathode was either 11/16 inch or 1 11/16 inches as shown in the Tables. An aqueous brine containing about 300 grams per liter sodium chloride was continuously fed into the anode chamber and a sodium hydroxide containing cell effluent was removed from the cathode chamber. Although chlorine gas was continuously removed from the anode chamber it was unnecessary to remove any gaseous product from the cathode compartment while the depolarizing cathode was functioning.

Operation of the cell was crrried out in a manner known to those skilled in the art with the exception that either oxygen or air was pumped through the gas compartment during operation. Tables I, II and III describe the specific operating conditions and operating results. From these results it is clear that the cell voltage was significantly reduced when the cathode was depolarized with either air or oxygen.

TABLE I

| Example [1] | 1 | 2 | 3 | 4 |
|---|---|---|---|---|
| Anolyte | | | | |
| NaCl (gm/liter) | 301 | 299 | 300 | 317 |
| $NaClO_3$ (gm/liter) | 0.017 | 1.14 | 2.62 | 0.323 |
| acidity (pH) | 2.98 | — | — | 4.04 |
| temperature (°C.) | 67 | 71 | 66 | 69 |
| head[3] | 9.0 | 10.0 | 12.5 | 7.0 |
| Catholyte | | | | |
| NaOH (gm/liter) | 101 | 120 | 127 | 108 |
| $NaClO_3$ (gm/liter) | 0.017 | 0.425 | 0.901 | 0.187 |
| temperature (°C.) | 70 | 72 | 69 | 70 |
| Chlorine Composition | | | | |
| $Cl_2$ (per cent) | 99.21 | 98.41 | 97.97 | 99.28 |
| $CO_2$ (per cent) | 0.54 | 0.85 | 0.71 | 0.40 |
| $O_2$ (per cent) | 0.19 | 0.70 | 1.29 | 0.25 |
| Distance between electrodes (inch) | 1–11/16 | 1–11/16 | 1–11/16 | 11/16 |
| Voltage (volts) | 2.46 | 2.92 | 3.63 | 1.98 |
| Current (amp.) | 1.50 | 2.2 | 3.0 | 1.50 |
| Current density (amp/in²) | 0.48 | 0.70 | 0.95 | 0.48 |
| Chlorine efficiency (per cent) | 98.55 | 96.95 | 96.1 | 98.70 |

[1] Oxygen used as the depolarizing gas.
[2] Reduction in efficiency is attributed to the particular asbestos diaphragm.
[3] Vertical distance in inches between the higher anolyte upper surface and the catholyte upper surface.

TABLE II[1]

| Example | Temperature (°C.) Anolyte | Temperature (°C.) Catholyte | Current (amp) | Current Density (amp/sq. in.) | Cell Voltage (volts) |
|---|---|---|---|---|---|
| 5 | 73 | 71 | .10 | .032 | 1.28 |
| 6 | 73 | 71 | .30 | .095 | 1.51 |
| 7 | 73 | 71 | .60 | .191 | 1.77 |
| 8 | 73 | 71 | .90 | .286 | 2.02 |
| 9 | 73 | 71 | 1.20 | .382 | 2.26 |
| 10 | 73.5 | 71 | 1.50 | .477 | 2.51 |
| 11 | 73.5 | 71 | 1.80 | .573 | 2.75 |
| 12 | 74.0 | 71 | 2.10 | .668 | 2.99 |
| 13 | 74.5 | 71 | 2.40 | .764 | 3.28 |
| 14 | 75.0 | 71 | 2.70 | .859 | 3.59 |
| 15 | 75.0 | 71 | 3.00 | .955 | 3.86 |
| 16 | 75.0 | 70 | 3.30 | 1.050 | 4.16 |
| 17 | 75.0 | 70 | 3.60 | 1.146 | 4.40 |

TABLE II[1]—continued

| Example | Temperature (°C.) Anolyte | Temperature (°C.) Catholyte | Current (amp) | Current Density (amp/sq. in.) | Cell Voltage (volts) |
|---|---|---|---|---|---|
| 18 | 75.0 | 70 | 4.00 | 1.273 | 4.69 |

[1] Distance between electrodes was 1-11/16 inches; oxygen was the depolarizing gas.

TABLE III[1]

| Ex. | Amp. | Amp/sq.in. | Cell Voltage Not Depolarized | Cell Voltage Oxygen Depolarized | Cell Voltage Air Depolarized |
|---|---|---|---|---|---|
| 19 | .10 | .032 | 2.22 | 1.28 | 1.34 |
| 20 | .30 | .095 | 2.39 | 1.51 | 1.54 |
| 21 | .60 | .191 | 2.62 | 1.77 | 2.21 |
| 22 | .70 | .223 | | | 2.50 |
| 23 | .90 | .286 | 2.86 | 2.02 | |
| 24 | 1.20 | .382 | 3.12 | 2.26 | |
| 25 | 1.50 | .477 | 3.35 | 2.51 | |
| 26 | 1.80 | .573 | 3.58 | 2.75 | |
| 27 | 2.10 | .668 | 3.77 | 3.00 | |
| 28 | 2.40 | .764 | 3.96 | 3.28 | |
| 29 | 2.70 | .859 | 4.16 | 3.59 | |
| 30 | 3.00 | .955 | 4.27 | 3.86 | |
| 31 | 3.30 | 1.050 | 4.49 | 4.16 | |
| 32 | 3.60 | 1.146 | 4.68 | 4.40 | |
| 33 | 4.00 | 1.273 | 4.99 | 4.69 | |

[1] Distance between electrodes was 1-11/16 inches.

What is claimed is:

1. In a process to produce chlorine and an alkali metal hydroxide in an electrolytic diaphragm cell by feeding an alkali chloride brine to an anode compartment and passing alkali metal ions through the diaphragm into a cathode chamber, supplying sufficient electrical energy to an anode positioned in the anode compartment and a cathode positioned in the cathode compartment to release gaseous chlorine at the anode and form an alkali metal hydroxide in the cathode compartment and recovering the chlorine and alkali metal hydroxide, the improvement comprising substantially simultaneously contacting different surface portions of the cathode with the catholyte and with an oxidizing gas, regulatably controlling the moisture content of the oxidizing gas entering the cell so as to minimize deposition of solid materials on the cathode and circulating the catholyte within the cathode compartment to thereby improve the electrical efficiency of the cell.

2. The improvement of claim 1 including feeding the oxidizing gas at a rate sufficient to minimize release of hydrogen into the catholyte.

3. The improvement of claim 1 including controlling the moisture content of the oxidizing gas within the range of from about 50 to about 100 per cent of saturation.

4. The improvement of claim 1 wherein the oxidizing gas is oxygen.

5. The improvement of claim 1 wherein the oxidizing gas is air.

6. The improvement of claim 1 wherein the alkali metal is sodium.

7. The improvement of claim 1 wherein oxidizing gas is controlled to minimize formation of oxidizing gas bubbles on the outer surface of the cathode.

8. The improvement of claim 7 wherein the outer surface of the cathode is substantially free of oxidizing gas bubbles.

9. The improvement of claim 1 wherein the moisture content of the oxidizing gas is controlled to minimize accumulation of liquid water within an oxidizing gas compartment in the cell.

10. The improvement of claim 3 wherein the moisture content of the oxidizing gas is controlled to minimize accumulation of liquid water within an oxidizing gas compartment in the cell.

* * * * *